US005082746A

United States Patent [19]

Forward et al.

[11] Patent Number: 5,082,746

[45] Date of Patent: Jan. 21, 1992

[54] AS-CONTINUOUSLY CAST BEAM BLANK AND METHOD FOR CASTING CONTINUOUSLY CAST BEAM BLANK

[76] Inventors: Gordon E. Forward, Texas Industries, Inc., 7610 Stemmons Freeway, Dallas, Tex. 75247; Libor F. Rostik; Lloyd M. Schmelzle, both of Chaparral Steel, 300 Ward Rd., Midlothian, Tex. 76065

[21] Appl. No.: 511,653

[22] Filed: Apr. 20, 1990

[51] Int. Cl.[5] ..... A22D 11/00; E04C 3/06

[52] U.S. Cl. ..... 428/582; 164/459; 52/729; 478/598

[58] Field of Search ..... 164/459, 418; 428/598, 428/603, 582; 52/729

[56] References Cited

U.S. PATENT DOCUMENTS

| | | | |
|---|---|---|---|
| 1,495,570 | 5/1924 | Blakeley | 52/729 |
| 3,416,222 | 12/1968 | Pearson | 164/418 |
| 3,910,342 | 10/1975 | Johnson . | |
| 4,023,612 | 5/1977 | Jackson . | |
| 4,565,236 | 1/1986 | Marui et al. . | |
| 4,635,702 | 1/1987 | Kolakowski et al. . | |
| 4,805,685 | 2/1989 | Lerento . | |

FOREIGN PATENT DOCUMENTS

| | | | |
|---|---|---|---|
| 0179364 | 4/1986 | European Pat. Off. . | |
| 0297258 | 1/1989 | European Pat. Off. . | |
| 56-109146 | 8/1981 | Japan . | |
| 0038223 | 8/1985 | Japan . | |
| 54293 | 3/1943 | Netherlands | 52/729 |
| 1091988 | 5/1984 | U.S.S.R. . | |
| 429325 | 6/1935 | United Kingdom | 52/729 |
| 1049698 | 11/1966 | United Kingdom . | |

OTHER PUBLICATIONS

Algoma Steel Corporation, Great Britain Patent GB 1,049,698.

Martynov, Mazun, Frolova, Gorlov and Nnechaev, Steel in the U.S.S.R., vol. 11, 1975.

Sladkoshteev, Gordienko, Gritsuk, Potanin and Kutsenko, vol. 7, Stal, 1976.

Lucenti Iron & Steel Engineer, Jul. 1969.

Yagi, Fastert and Kunga, 1975 AISE Annual Convention, Cleveland, Ohio.

Ushijima, Transactions ISIJ, vol. 15, 1975.

Saito, Kodama and Komoda, Iron and Steel International, vol. 48, Oct. 1975.

Puppe and Schenck, Stahl und Eisen, Dec. 4, 1975.

Hartmann, European Patent Aplication 0 297 258.

Ehrenberg, "Controlling of Thin Slabs at the Mannesmannrohren-Werke AG", MPT International, Mar. 12, 1989, p. 52.

Guglin, Provorny, Zasetskey and Gulyaev, Stal (1961).

Marr, Witt, Marsden and Marshall, Journal of the Iron and Steel Institute, Dec. 1966.

*Primary Examiner*—Kuang Y. Lin

*Attorney, Agent, or Firm*—Jones, Day, Reavis & Pogue

[57] ABSTRACT

An as-continuously cast beam blank comprising a web portion and a plurality of opposed flange precursor portions extending from opposite ends of the web portion, the web portion having an average thickness of no greater than about 3 inches, each of said flange precursor portions having an average thickness of no greater than about 3 inches, wherein the ratio of the average thickness of the flange precursor portions to the average thickness of the web portion preferably is between about 0.5:1 to about 2:1; a beam formed from that beam blank, and a method for casting a continuously-cast beam blank having those characteristics from a single molten metal stream open poured into a beam blank mold at a location in the mold within the mold portion which forms the web of the blank, proximate to one of the ends of the web portion, or, alternatively, from two separate, simultaneously poured molten metal streams, each of said streams being open poured into a beam blank mold at a location in the mold within the mold portion which forms the web of the blank, proximate to each of a respective one of the ends of the web portion; the resulting beam blank having a crystal grain structure of fine ferrite and pearlite, substantially free of acicular ferrite and grain boundary ferrite films.

56 Claims, 4 Drawing Sheets

AS-CONTINUOUSLY CAST BEAM BLANK AND METHOD FOR CASTING CONTINUOUSLY CAST BEAM BLANK

BACKGROUND OF THE INVENTION

1. Field of the Invention

The invention relates to shaped structural members, particularly as-continuously cast beam blanks, from which finished structural beams are subsequently fashioned.

2. Description of the Related Art, Including Information Disclosed Under 37 C.F.R. §§ 1.97–1.99

Shaped structural members formed of metal, particularly of carbon or low-alloy steel, are used in various applications. Shaped structural members of various configurations are well-known to the metal forming art, and include beams. Beams conventionally have a web portion with opposed flanges extending from both ends of the web portion in a direction substantially normal thereto. Beams are usually formed from a casting of the steel, such as an ingot casting, which is subsequently hot worked by known methods to the desired finally-dimensioned and configured beam structure. Alternately, beams may be formed by a continuous casting operation which forms either a billet for subsequent hot working to form the beam or produces a shaped cross-section casting having a cross-section approximating the final configuration of the beam, which casting is then subjected to a series of hot and then cold rolling operations to form the finally dimensioned and configured beam product. Continuous casting has the advantage that a series of beam blanks may be formed from one or more heats of steel in a substantially continuous operation. This enables energy savings to be achieved and also improves the quantity of production. In the steel industry, the term "beam blank" denotes such a shaped cross section casting, a semifinished product with a shaped cross section approximating a beam configuration, which when subjected to further rolling steps is converted from that semifinished, as-cast state to a finished product having the desired and required final dimensions and specific, final configuration. Beam blanks are used as a precursor or starting material for the production of a variety of final structural member shapes, including H shaped beams, I shaped beams (usually referred to as "I beams") wide flange profile beams, British standard profile beams, Japanese industrial standard profile beams, and rail profiles, including railroad, crane and gantry rails.

As is well-known in the steel making art, hot rolling operations take the approximate-shape blank and reduce the shape to the finally dimensioned and shaped article, while altering the initial metallurgy and crystallization of the steel to the ultimate, desired state, with the required crystal state and form. Additional operations are then normally utilized to straighten the finally-dimensioned and configured member, and to cut the member to the desired length.

A mold for the continuous casting of such beam blanks typically has a central casting passage which is bounded by a pair of parallel walls which is designed to form the web of the beam blank. On either side of the central casting passage are second casting passages which each widen in a direction away from the central casting passage. These second or expanding casting passages are designed to form the inner portion of the flanges or flange precursors of the beam blank. Each of the expanding casting passages merges into a generally rectangular terminal casting passage designed to form the outer portion of the flanges or flange precursors of the beam blank.

Early attempts at shaped cross section casting, specifically including beam blanks, were first reported in about 1961 (N. N. Guglin, A. K. Provorny, G. F. Zasetskey, and B. B. Gulyaev, Stal (1961)), involving, on a laboratory scale, a simple 125° wide angled section with two legs of unequal (30 and 40 mm, respectively) thickness. The casting encompassed an area of approximately 127 $cm^2$. These laboratory scale experiments did not initially indicate the viability of the concept for use in continuous casting processes.

Certain other laboratory work was later carried out by British Iron and Steel Research Association ("BISRA") at its Sheffield Laboratories (H. S. Marr., B. Witt, B. W. H. Marsden, and R. I. Marshall, *Journal of the Iron and Steel Institute*, December 1966), to produce shaped cross section castings, including beam blanks. G.B. 1,049,698 (1965) describes symmetrical and asymmetrical shapes, including approximate configurations which could generally be described as roughly railroad rail-type in cross section, hour-glass type in cross section and I beam-type in cross section. The I beam-type cross section castings averaged 670 $cm^2$ in area, with dimensions of 464 ×254×76 (web length×flange height×web thickness, mm [18¼"×10"×3"]).

Further research activity undertaken by BISRA with Algoma Steel Corporation, Ltd. (Sault-Sainte-Marie, Ontario, Canada), studied the possibility of casting beam blanks for subsequent rolling to wide-flange universal I beams using the techniques described in G.B. 1,049,698. A commercial two (2) strand unit for continuous casting of such beam blanks was installed at Algoma in 1968. The beam blank sections cast by this installation averaged between 845–1435 $cm^2$ in area, with dimensions of various combinations, including 451×305×102; 559×267×102; 775×356×102; 673 ×260 ×102; and 1164 ×356 ×102, mostly having the approximate I beam-type cross section.

A number of shaped cross section continuous casting devices for the production, inter alia, of beam blanks were installed in the period subsequent to 1968, which produced one or more of the three noted type cross section blanks. These comprised a number of Japanese installations, including those at Kawasaki Steel Corporation, a four (4) strand bloom/beam blank caster, installed at Mizushima, Okayawa, Japan (beam blank sections averaged 1155 $cm^2$, with dimensions of 460 ×400 ×120 and 560 ×287 ×120); Tokyo Steel Manufacturing Co. Ltd's. single (1) strand unit at Kohchi Works, Shikoku, Japan (beam blank sections averaged 820 $cm^2$, with dimensions of 445 ×280 ×110); a single (1) strand unit at the Himeji Works of Yamato Kogyo KK, Himeji, Japan (beam blank sections averaged 1100 $cm^2$, with dimensions of 460 ×370 ×140); and a four (4) strand beam blank installation at Nippon Kohan KK's Fukuyama facility, Fukuyama, Japan (beam blank sections averaged 1145–1165 $cm^2$, with dimensions of 480×400×120), as well as a number of European and Russian installations, including those at Mannesmann AG, Huttenwerke, Huckingen-Duisburg, West Germany (beam blank sections averaged 460 cm in area, with dimensions of 350 ×210 ×80); Research Development Works, Tula, USSR, described in O. V. Martynov, A. I. Mazun, I. B. Frolova, S. M. Gorlov and L.

S. Nechaev, Steel in the USSR. 11 (1975) (beam blank sections averaged 550 $cm^2$ in area, with dimensions of 245 ×310 ×130, the web length being shorter than the flange height); Ukrainian Metals Research Institute, USSR, described in V. T. Sladkoshteev, M. S. Gordienko, N. F. Gritsuk, R. V. Potanin and L. D. Kutsenko, Stal, 7 (1976) (beam blank sections averaged 520 $cm^2$ in area, with dimensions of 415×284×50); and British Steel Corp., General Steels Division, Stoke-on-Trent, U.K. (beam blank sections averaged 790 $cm^2$, with dimensions of 286×355×178 mm [11½"×14"×7"], the web length being shorter than the flange height).

Other comments relating to shaped cross section casting and continuous casting devices for shaped cross section casting to produce, among other cross-sectional forms, beam blanks, appeared in various articles and papers, including G. S. Lucenti, *Iron and Steel Engineer* (July 1969); Y. Yagi, H. Fastert and H. Tokunaga, 1975 AISE Annual Convention (Cleveland, Ohio); K. Ushijima, *Transactions ISIJ.* 15 (1975); T. Saito, M. Kodama, and K. Komoda, *Iro and Steel International,* 48 (October 1975); and W. Puppe and H. Schenck, Stahl und Eisen 95, 25 (December 4, 1975).

Hartmann European Patent Application 0 297 258 (assigned to SMS Schloemann-Siemag AG), discloses a mold for the continuous casting of a "pre-profiles for beam rolling" (continuously cast beam blanks), which is used in combination with a submerged casting tube in the web portion of the mold. The mold is independently adjustable with respect to web height, web thickness and flange thickness, allowing variation of all three dimensions to produce a beam blank consisting of a web and two flanges. The Hartmann mold is also configured to comprise, in the web area, a widened arch-like or bulged metal inlet area, to afford ready introduction of the melt through a casting dip tube submerged under the bath surface, and to provide good distribution of the cast metal to the end areas of the blank. No relationship between web thickness and the width of the flange precursor portions arguably castable through use of that mold is disclosed by Hartmann, nor is there any disclosure or allusion to a maximum web and/or flange or flange precursor thickness in the virtually infinite number of products which that mold could be used to prepare.

DE-AC 2 218 408, noted by Hartmann, discloses a mold in which molten steel is fed within the web portion of the mold from an intermediate container through a submerged casting dip tube. That mold is adjustable to change the flange thickness, but not to vary either the web height or the web thickness.

Other special mold configurations were disclosed as necessary to control the stress and cracking problems which the known beam blanks encountered. Masui et al. U.S. Pat. No. 4,565,236, issued January 21, 1986, teaches the avoidance of cracks formed in the fillet parts of beam blanks, between the web and flange precursor portions, by the use of a mold cavity provided both with a taper at its web part in the casting direction, and variation in the curvature 1/R of the curved fillet parts of the mold cavity in the casting direction. The variation of the curvature is done in accordance with the amount of free shrinkage of the solidified shell of the beam blank strand (Abstract). Masui et al. state that their invention is particularly significant in the casting of beam blanks of large dimension or having a web height exceeding 775 MM (col. 10, 11. 53–65; FIG. 9, H=web height), and is the mechanism required to provide beam blanks with an inner web height (FIG. 9, W=inner web height) greater than 500 mm. No disclosure of attempting to avoid these problems by control of the maximum thickness of the various portions of the beam blank or the relationship of those portions to each other appears in Masui et al.

The continuous casting of shaped cross section beam blanks has the commercial advantage of enabling the production of a series of beam blanks from one or more heats of steel supplied to the process and apparatus, for as long a production run as the manufacturer chooses, without the need to first cast billet, reheat it and then subject that square stock to the processing necessary. In this manner, savings are achieved from the standpoint of producing a cast product that is closer to the final desired configuration than is achieved with either ingot casting or casting of a billet.

It is also known to produce beam blanks by continuously casting the metal in molten form into a continuous casting mold having what could be described as a "dog-bone"-shaped cross-section, a variation on the hour glass-type cross section. A particular example of the known practices for producing "dog-bone" shaped beam blanks by continuous casting is described in Lorento U.S. Pat. No. 4,805,685, issued Feb. 21, 1989. "Dog-bone" shaped beam blanks have been produced in commercial installations, with web thicknesses of at least four (4) inches and with flange or flange precursor portions of much greater size and thickness.

All of the aforenoted conventional practices and the beam blanks resulting therefrom have the disadvantage that the expanded end portions of the beam blank, the flange precursor portions, because of their increased cross-sectional area relative to the web portion of the beam blank, together with the thick web portion, require extensive hot rolling to achieve the final, required flange structure of the beam. This adds considerably to the complexity and overall cost of producing the beam, particularly in energy costs. In addition, high-cost heavy-duty hot rolling mills or millstands are required to achieve the necessary reductions of the expanded end portions of the beam blank, as well as cold rolling mill or millstand equipment for finishing operations (straightening and cutting to length), all of which comprise a tremendous required capital investment. The various continuously-cast shaped beam blanks known in the art must also be subjected to these substantial levels of hot working not just to achieve the final desired beam dimensions, but also to provide the necessary metallurgical structures and properties (including crystallization) of the metal required to be present in the finished structural member.

With respect to the BISRA laboratory work, for example, it was found that a hot working reduction of at least 6:1 was necessary to convert the as-cast shaped beam blank structure to attain final product dimension and to achieve the necessary metallurgical properties (H. S. Marr et al, supra). For a series of finished I beam sizes, the actual reduction was far higher, averaging between about 8:1 to about 10.5:1:

| Rolled Beam Size | | | |
|---|---|---|---|
| Inch H × B | mm H × B | Area cm2 | Reduction in Area |
| 14 × 6¾ | 356 × 171 | 64.5 | 10.4:1 |
| 16 × 7 | 406 × 178 | 76.1 | 8.8:1 |

-continued

| Rolled Beam Size Inch H × B | mm H × B | Area cm2 | Reduction in Area |
|---|---|---|---|
| 16 × 7 | 406 × 178 | 68.4 | 9.8:1 |
| 18 × 7½ | 457 × 191 | 85.1 | 7.9:1 |

The Algoma Steel Corporation installation required an equivalent level of necessary further hot-working, with reduction ranging from about 6:1 to about 17.5:1:

| Cast Beam Blank Size | Rolled Beam Size inch H × B | mm H × B | Area cm2 | Reduction in Area |
|---|---|---|---|---|
| | 12 × 10 | 305 × 254 | 100.6 | 8.4:1 |
| | 12 × 10 | 305 × 254 | 110.3 | 7.7:1 |
| | 12 × 8 | 305 × 203 | 76.1 | 11.1:1 |
| | 12 × 8 | 305 × 203 | 85.1 | 9.9:1 |
| | 12 × 8 | 305 × 203 | 94.8 | 8.9:1 |
| [17¾" × | 12 × 6½ | 305 × 165 | 51.0 | 16.6:1 |
| 12" × 4", | 12 × 6½ | 305 × 165 | 58.7 | 14.4:1 |
| 845 cm²] | 12 × 6½ | 305 × 165 | 68.4 | 12.4:1 |
| | 14 × 8 | 356 × 203 | 81.3 | 10.4:1 |
| | 14 × 8 | 356 × 203 | 90.9 | 9.3:1 |
| | 14 × 8 | 356 × 203 | 100.6 | 8.4:1 |
| | 14 × 6¾ | 356 × 171 | 56.8 | 14.9:1 |
| | 14 × 6¾ | 356 × 171 | 64.5 | 13.1:1 |
| | 14 × 6¾ | 356 × 171 | 72.2 | 11.7:1 |
| | 18 × 7½ | 457 × 191 | 76.1 | 11.5:1 |
| | 18 × 7½ | 457 × 191 | 85.1 | 10.3:1 |
| | 18 × 7½ | 457 × 191 | 94.8 | 9.2:1 |
| | 18 × 7½ | 457 × 191 | 104.5 | 8.4:1 |
| [22" × | 18 × 7½ | 457 × 191 | 114.2 | 7.6:1 |
| 10½" × 4", | 16 × 7 | 406 × 178 | 60.6 | 14.4:1 |
| 873 cm²] | 16 × 7 | 406 × 178 | 68.4 | 12.8:1 |
| | 16 × 7 | 406 × 178 | 76.1 | 11.5:1 |
| | 16 × 7 | 406 × 178 | 85.1 | 10.3:1 |
| | 16 × 7 | 406 × 178 | 94.8 | 9.2:1 |
| | 16 × 5½ | 406 × 140 | 49.7 | 17.6:1 |
| | 16 × 5½ | 406 × 140 | 58.7 | 14.9:1 |
| | 24 × 9 | 610 × 229 | 129.0 | 11.1:1 |
| | 24 × 9 | 610 × 229 | 144.5 | 9.9:1 |
| [30½" × | 24 × 9 | 610 × 229 | 159.3 | 9.0:1 |
| 14" × 4", | 24 × 9 | 610 × 229 | 178.0 | 8.1:1 |
| 1434 cm²] | 24 × 12 | 610 × 305 | 189.6 | 7.6:1 |
| 6.9:1 | 24 × 12 | 610 × 305 | 209.0 | |
| | 24 × 12 | 610 × 305 | 227.7 | 6.3:1 |

Similarly, the Kawasaki Mizushima installation required hot-working reductions of about 9.5:1 to about 18:1, to achieve final product I beams with the desired size and requisite metallurgy:

| Rolled Beam Size H × B (mm) | Area cm2 | Reduction in Area |
|---|---|---|
| 300 × 300 | 119.8 | 9.6:1 |
| 250 × 250 | 92.2 | 12.5:1 |
| 350 × 250 | 101.5 | 11.4:1 |
| 350 × 200 | | |
| 400 × 200 | 84.1 | 13.7:1 |
| 300 × 200 | 72.4 | 16.0:1 |
| 350 × 175 | 63.1 | 18.3:1 |

While the known shaped continuous casting processes disclose a variety of beam blank sizes and configurations, there is no teaching or disclosure in the art of any intentional or recognized interrelationship between any of the parameters of the as-cast beam blank. Particularly lacking is any teaching or disclosure of limitation on the average thickness of the web portion of the blank, on the average thickness of the flange precursor portions of the blank, or any limitation or relationship between the average thickness of the flange precursor portions and the average thickness of the web, or any combination of a limitation on the average web thickness of the blank, and on the average flange precursor portion thickness of the blank, or further including a relationship between the average thickness of the flange precursor portions and the average thickness of the web.

The prior art continuously cast beam blanks all had at least a four (4) inch thick web portion, irrespective of whether the overall blank shape was rail-type in cross section, hour glass-type in cross section, or beam-type in cross section. These blanks had very thick flange precursor portions as well. The massiveness of the resulting blank was, in some measure, a primary reason for the substantial, costly hot-rolled reductions in cross-section and modifications in shape that the prior art mandated. It also presented an as-cast metallurgy that was unacceptable without substantial further hot-working, which, in most instances, could be effected before the required final dimensions of the structural member could be obtained. Preservation of the desired metallurgical properties through the further hot roll passes to complete the member proved difficult in most cases, impossible in many.

The existing continuously cast beam blanks and beam blank casting techniques were also limited by the known procedures needed to effect the casting operations.

The use of a submerged casting nozzle was taught by the prior art as necessary where commercial continuous casting speeds and commercial quality in the as-cast blank were required with thin section slab castings. Various submerged nozzle constructions, such as that disclosed in European Patent Application No. 0 336 158, were disclosed as useful in such casting procedures.

Due to the space relationships in the continuous casting mold, and the high casting speeds necessary and desired in commercial operations, there were difficulties in achieving a constant, controlled rate of solidification when thin sections were produced in thin slab casting operations. This often resulted in longitudinal cracks in casting certain steel grades, which presented severe quality and integrity problems. To avoid this problem, the use of a specially formulated casting powder was disclosed to be necessary. See H. J. Ehrenberg et al., *Controlling of Thin Slabs At the Mannesmannrohren-Werke AG*, MPT International, 12, 3/89, p.52.

The known techniques, then, mandated the use of both submerged nozzle pouring in the mold section and of casting powder, particularly where a thin section was required. Although not taught in the art, any attempt to use thin slab casting concepts in connection with beam blank casting would of necessity include submerged nozzle pouring and casting powder use.

Each of the known prior continuously cast beam blanks or pre-forms, and the techniques for producing them, suffered from a variety of serious shortcomings and problems. In all of the known prior continuously cast beam blanks, the web thickness substantially exceeded three (3) inches, usually exceeding four (4) inches. The "ears" portions (or flange precursor portions) of these blanks was massive in relation to said web thicknesses. During cooling and solidification of the metal during the continuous casting of these beam blanks in the manner known in the prior art, temperature gradients form in the liquid metal. These gradients promote the formation of a columnar structure. The beam blanks are often as a result characterized by a micro-structure having planes of weakness throughout the cross-section resulting in inferior metallurgical properties, particularly ductility and toughness.

Also, the amount of hot working, through use of conventional rolling techniques using known millstand-type equipment, is very substantial, averaging in excess of 15 passes, with up to 32 passes being necessary. The capital expenditure for the required rolling equipment is very substantial, and the time necessary and energy expended to make the high number of passes needed is not inconsequential. Achievement and preservation of desired metallurgy through the rolling regimen is complicated. Undesired and uncontrolled over-or under-elongation of the web portion of the blank is often experienced and difficult to accurately predict or control. Further, tearing of flange precursor/flange portions of the beam is a constant and substantial problem, as is buckling of the web portion. Restrictions on pouring points and technique are severe: open pouring had to be carried out into the mold zone corresponding to the approximate center of one of the massive "ear" portions of the known blank structures.

No teaching of any relationship between web or flange thickness in a cast beam blank and ease of the achievement of desired metallurgical properties in the beam blank or product has been advanced, nor has there been any disclosure relating web thickness to the thickness of the flange precursor portions of the beam blank in any manner, with or without control of the maximum web or flange thickness.

There was thus a need for an as-continuously cast beam blank and process for producing same, that:

1. Approximates the finished shape and configuration of the beam or other structural shape desired;

2. Minimizes the number of hot rolling passes or steps that must be undergone to reach the desired final size, which in turn would minimize the capital expenditure required to produce such blanks, and would markedly reduce the extreme energy costs which marked the prior art process;

3. Provides the desired metallurgical properties with the minimum number of rolling steps possible, and preserves those properties through any minimal additional rolling steps needed to reach desired final size, the number of steps required to obtain the desired metallurgical properties being substantially less than the number required with known beam blanks and processes;

4. Does not require the use of submerged pour techniques, and does not require the use of casting powder; and 5. Controls the relationship between web thickness and flange precursor thickness, to effect control over both required working and minimize tearing of flanges and undesired elongation and/or buckling of web portions and resulting distortion of the blank, as well as providing for rapid solidification in the mold with its accompanying metalurgical property benefits.

No available continuously cast beam blank, or process for producing same, provided the noted combination of advantages—minimal number of rolling passes to achieve both finished shape and desired metallurgy, with no undue web elongation or buckling or flange tearing; ability to use open pouring techniques and avoid mandatory use of submerged casting techniques, and/or casting powder, even where thin cross section webs are required; and improved, metallurgical characteristics which is carried into the finished beam and conserved by control over the number of hot rolling passes needed to reach final dimension and product configuration.

SUMMARY OF THE INVENTION

It is accordingly a primary object of the present invention to provide an as-continuously cast beam blank that may subsequently be rolled to form a beam by a reduced series of hot rolling operations requiring smaller and less expensive rolling equipment relative to conventional practices, with concomitant savings in process time and expended energy in the fabrication of such finished article.

Another object of the invention is to provide an as-continuously cast beam blank wherein the composition and micro-structure is controlled to provide a finally dimensioned beam having the desired metallurgical properties when manufactured therefrom, as compared to the beams resulting from conventional processes.

Broadly, in accordance with the invention, there is provided an as-continuously cast beam blank comprising a web portion and a plurality of opposed flange precursor extending from opposite ends of the web portion. The web portion has an average thickness of no greater than about 3 inches, and each of the flange precursor portions has an average thickness of no greater than about 3 inches. A further version of the invention provides a blank wherein these maximum web and flange dimensions are provided, and the ratio of the average thickness of the flange precursor portions to the average thickness of the web portion is between about 0.5:1 to about 2:1. This permits the advantageous lowering of the reduction ratio required to achieve the desired mechanical properties, usually to around 3:1, while establishing the desired and required metallurgical properties. By selecting and maintaining the web thickness, flange precursor thickness, and, preferably, the ratio of the thickness of the flange precursor portions to the web thickness, the advantageous micro-structure of both the beam blank and the ultimate finished beam structure is provided. The as-cast micro-structure and metallurgical properties are sufficiently close as a precursor to reach a final form which is preferred for structural members with a minimal further hot working regimen. In fact, the final micro-structure is achievable, from the beam blanks of the invention, in substantially the same number of hot-rolling passes that is required to reach final dimensions for the desired product. No risk of adverse alteration to the metallurgical properties is presented by the need for several additional hot-rolling passes to complete product dimensioning, a marked improvement of the invention over the prior art.

The web portion and flange precursor portions may each have a thickness within the range of 1½ to 3 inches. Each flange precursor portion of the beam blank may be of substantially equal thickness. The thickness of the web portion may be greater than the thickness of each of the flange precursor portion or alternately each of the flange precursor portions may have a thickness greater than the thickness of the web portion.

Two flange precursor portions may extend from each end of the web portion of the beam blank with each flange having essentially parallel sides. The sides of the web portion may also be parallel. The two flange portions at each end of the web portion may be separated by an angle between their respective longitudinal center lines within the range of 30 to 180 degrees.

The term "beam blank" as used herein is intended to mean a continuous metal form, as cast, comprising web and flange precursor or preform portions, which when subjected to further manufacturing steps will produce a finally dimensioned and configured [I] beam.

The term "beam near net shape" as used herein is intended to mean a continuous metal form, as cast, comprising web and flange precursor or preform portions, which may be converted to the final dimensioned, finished beam article by subjecting to necessary hot working involving no more than 15 hot rolling passes in total. In particular, that term is intended to mean such a continuous metal form wherein (i) the web and flanges each have a thickness within the range of 1½ to 3 inches; (ii) each flange of the beam blank is of substantially equal thickness; (iii) two flanges extend from each end of the web portion of the beam blank with each flange having substantially parallel sides; (iv) the sides of the web portion may also be parallel; and (v) the two flanges at each end of the web portion are separated by an angle within the range of 30 to 180 degrees.

The term "as-continuously cast" as used herein is intended to identify the structure resulting upon cooling after continuous casting in the absence of any hot working operations. This is the structure of the continuously cast beam blank immediately upon cooling and solidification from the continuous casting operation.

The beam blanks of the invention provide the desired metallurgical properties for the finished beam products due to the relatively rapid and uniform solidification in the mold of both the web portion and all of the flange precursor portions. The controlled maximum thickness of both the web portion and the flange precursor portions allows relatively uniform heat transfer to occur at standard commercial continuous casting speeds from all portions of the blank at substantially the same rate, which produces a uniform finer grain in the metal throughout than was known to the prior art to be achievable in such beam blanks. The rapid solidification prevents unwanted grain growth, and the overall beam configuration and sizing aids in preventing coarsening of the grain during further processing, which avoids loss of yield strength and tensile strength, and enables the preservation of toughness. The desired microstructure results earlier in the hot-rolling regimen than when the prior art blanks were used, usually when a reduction of about 3:1 has been effected. (The known prior art blanks required a reduction of no less than about 6:1 to approach the same metallurgical properties).

There is also provided, according to the invention, an as-continuously cast beam blank comprising a web portion and a plurality of opposed flange precursor portions extending from opposite ends of said web portion, said web portion having an average thickness of no greater than about 3 inches and each of said flange precursor portions having an average thickness of no greater than about 3 inches, wherein the beam blank is continuously cast from a single molten metal stream open poured into a beam blank mold at a location in said mold within the portion of the mold which forms the web of said blank, proximate to one of said ends of said web portion. The ratio of the average thickness of the flange precursor portions to the average thickness of said web portion may be between about 0.5:1 to about 2:1.

There is further provided, still according to the invention, an as-continuously cast beam blank comprising a web portion and a plurality of opposed flange precursor portions extending from opposite ends of said web portion, said web portion having an average thickness of no greater than about 3 inches and each of said flange precursor portions having an average thickness of no greater than about 3 inches, wherein the beam blank is continuously cast from two separate simultaneously-poured molten metal streams, each said stream being open poured into a beam blank mold at a location in said mold within the portion of said mold which forms the web of said blank, proximate to a respective one of said ends of said web portion. Again, the ratio of the average thickness of the flange precursor portions to the average thickness of said web portion may be between about 0.5:1 to about 2:1.

Certain improved processes are also provided according to the invention for manufacture of as-continuously cast beam blanks of the invention. First, in a process for continuously casting a beam blank, the blank comprising a web portion and a plurality of opposed flange precursor portions extending from opposite ends of the web portion, the improvement comprises casting the beam blank from a single stream of molten metal open poured into a beam blank mold at a location in the mold, within the mold portion which forms the web of the blank, proximate to one of said ends of the web portion, the web portion having an average thickness of no greater than 3 inches.

Second, in a process for continuously casting a beam blank, the blank comprising a web portion and a plurality of opposed flange precursor portions extending from opposite ends of the web portion, the improvement comprises casting the beam blank from two separate simultaneously-poured streams of molten metal, each stream being open poured into a beam blank mold at a location in the mold, within the mold portion which forms the web of the blank, proximate to a respective one of said ends of said web portion, the web portion having an average thickness no greater than 3 inches.

The web portion and flanges of the as-continuously cast beam blanks of the invention have a crystal grain structure of fine ferrite and pearlite substantially free of acicular ferrite and grain boundary ferrite films. The "crystal grain structure of fine ferrite and pearlite substantially free of acicular ferrite and grain boundary ferrite films" is intended in accordance with the invention to define the as-cast structure in accordance with the invention typified by the crystal structure shown in the photomicrograph, constituting FIG. 2 hereof. This structure is characteristic of the outer, rapidly cooled portion of a prior art bloom or billet casting, as opposed to the interior portion which is of a grain structure as shown in FIGS. 3 and 4 which grain structure resulted in known beam blanks. These figures show a conventional as-continuously cast micro-structure of acicular ferrite having a very large grain size, with grain boundaries of pro-eutectoid ferrite which outlines the prior austenite grains.

The term "substantially free" is intended to indicate that acicular-ferrite and pearlite may be present in the as-continuously cast beam blank of the invention in minor amounts not affecting the properties thereof.

With use of a billet as the starting form for the rolling of an I-beam structural member, up to 72 passes through hot rolling millstands are necessary to produce the desired metallurgy, finish dimensions and configuration of the structural member. If the "dog-bone" type continuously cast beam blank is used as the starting form, up to 32 passes are necessary. The desired metallurgy will usually result after about 15 passes through hot rolling millstands, the remaining passes being necessary to take the blank down to the finished dimensions and configuration. The "dog-bone" blank, however, remains susceptible to the elongation difficulties on rolling which had long plagued the manufacturing of beams by this technique, which lead to the tearing of flanges and/or the over-elongation or buckling of the web. The number of passes required with the "dog bone" blank also requires the same substantial capital investment and high energy costs which characterize the prior art blanks and methods of their production.

The beam blank of the invention, however, affords production of the desired final beam in the minimum number of passes; usually, final finished shape is attainable in no more than 15 hot rolling passes, the minimum working necessary to attain the desired metallurgy, which is consistent with about 3:1 reduction. Similarly, the configuration of the beam blank of the invention, because it is far closer in shape to the desired finished beam than the prior art blanks, minimizes the stresses and strains upon the metal during rolling, which in turn reduces uneven flange/web elongation, tearing of flanges and web buckling.

Minimizing the number of passes necessary to achieve both desired final shape and metallurgy greatly reduces the capital expenditure necessary to set up the process of the invention, to produce the products. Substantial savings in energy also result, and, because of the pass reduction, the process is markedly shortened, which in turn increases the potential input/throughput of blanks of the invention through further manufacturing to end products, without increase in the number of continuous casting lines or equipment.

While the invention optimally provides for the use of open pour techniques, most preferably with simultaneous use of a rapeseed or equivalent oil lubricant/barrier layer to control oxidation, through which pour is effected, it is also contemplated that, as an option, submerged pour techniques may also be used, if preferred with use of casting powder, but these techniques are not necessary.

The invention thus satisfies the aforenoted lackings and shortcomings in the prior art as-continuously cast beam blanks and processes for continuously casting beam blanks.

DESCRIPTION OF THE PREFERRED EMBODIMENTS

Figure 1:
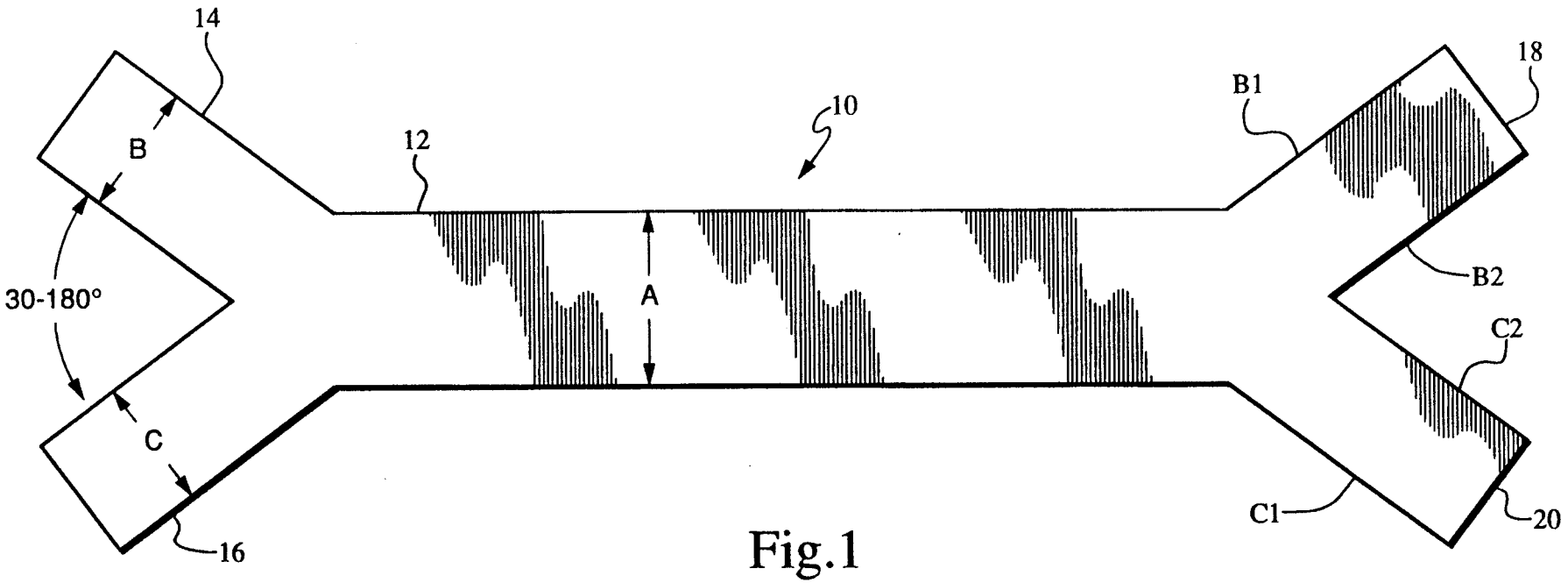
FIG. 1 is a schematic view of the cross-section of an as-continuously cast beam blank in accordance with the invention.
Figure 3:
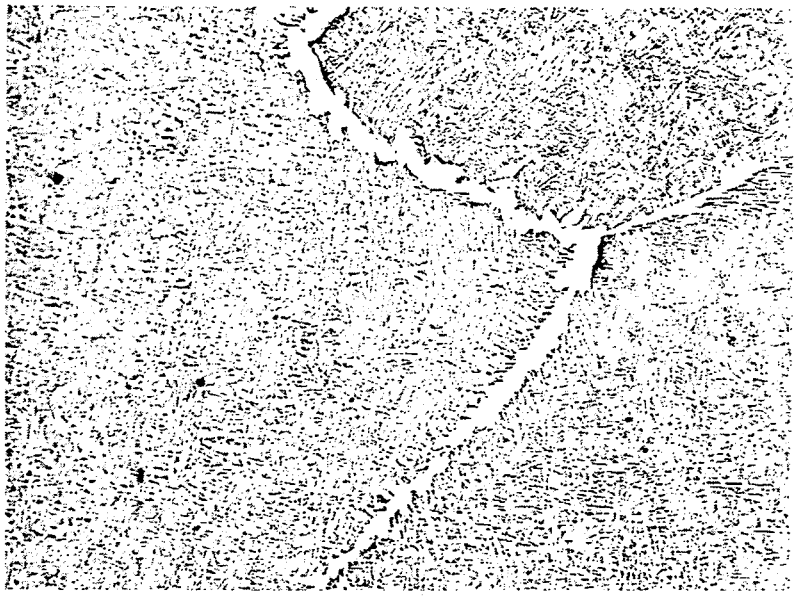
FIG. 3 is a photomicrograph (50×magnification of a conventional, as-continuously cast bloom.
Figure 4:
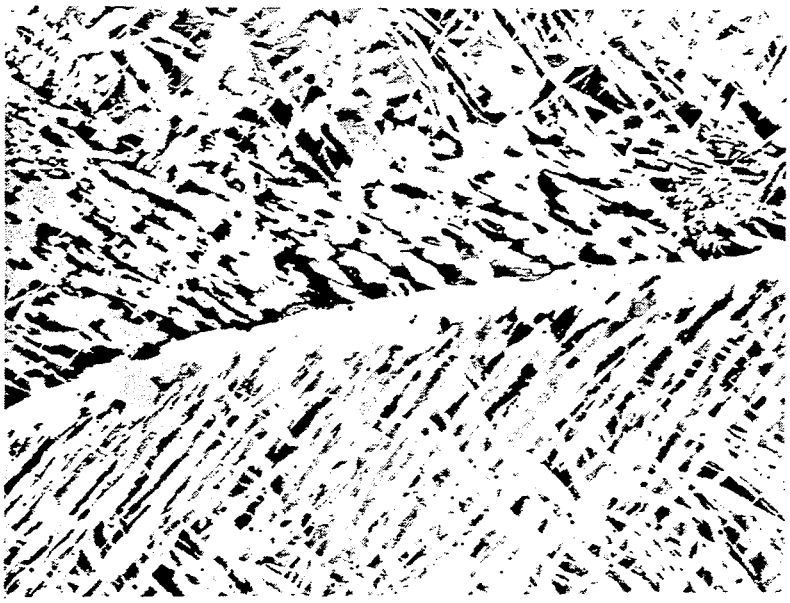
FIG. 4 is a photomicrograph (50×magnification of a conventional, as-continuously cast billet.

With reference to FIG. 1 of the drawings, there is shown schematically an as-continuously cast beam blank constituting an embodiment of the invention, which is designated generally as 10. The beam blank 10 has a web portion 12 and opposed flanges 14, 16 and 18, 20 extending from opposite ends thereof. The flanges extending from each opposed end of the web portion 12 of the beam blank may be separated by an angle between their respective longitudinal center lines of between about 30 to about ½degrees. The web thickness, the flange precursor thickness, the ratio of web thickness to flange precursor thickness, and the angular separation of the flange precursors are all maintained to ensure sufficiently rapid cooling during the continuous casting of the beam blank to achieve a crystal grain structure of fine ferrite and pearlite substantially free of acicular ferrite and grain boundary ferrite films throughout the entire cross-sectional area of these flanges. Otherwise, the interior sides or surfaces of the flange precursor portion will cool less rapidly than the remainder of the beam blank to result in the significant presence of the crystal grain structure shown in FIGS. 3 and 4 and described above.

As shown in FIG. 1, the thickness A of the web portion may be the same as the thickness B and C of the flanges 14, 16, 18 and 20. In this embodiment, the thickness B and C of these flanges are substantially equal with the sides B-1, B2 and C1, C2 thereof being substantially parallel. With the as-cast dimensions and configuration of the beam blank shown in FIG. 1, sufficiently rapid and uniform cooling of the molten metal during continuous casting may be achieved to ensure the production of the desired crystal grain structure of fine ferrite and pearlite substantially free of acicular ferrite and grain boundary ferrite films throughout the entire cross-section of the beam blank.

As is well known in continuous casting of beam blanks, a flow-through, water-cooled copper continuous casting mold is employed with an interior configuration conforming to that of the desired final beam blank cross-section. Because of the contraction of the molten alloy during cooling it is conventional practice to construct the continuous casting mold with the walls thereof being gradually inclined in the casting direction to compensate therefor as the molten alloy progressively cools and solidifies during passage through the mold. The exit end of the mold conforms substantially to the desired cross-sectional size and configuration of the final beam blank emerging from the mold.

Figure 2:
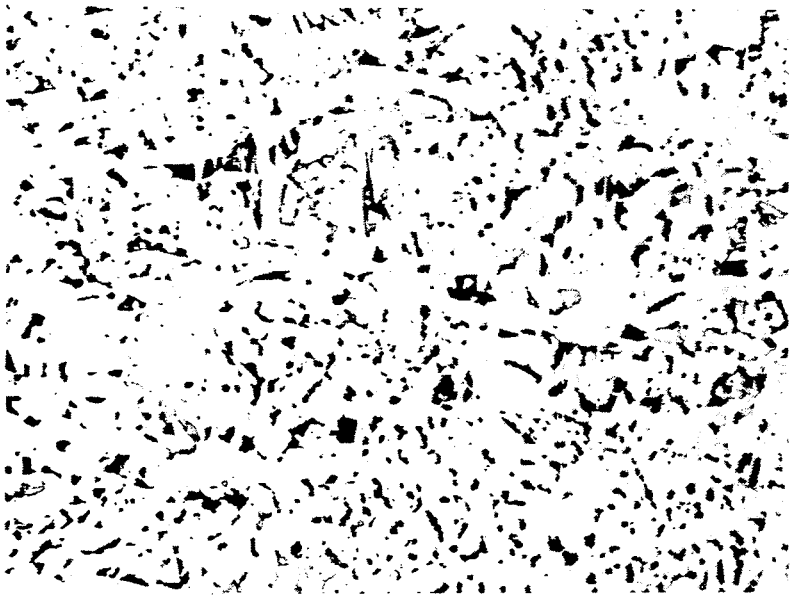
FIG. 2 is a photomicrograph (50×magnification) of the crystal grain structure of fine ferrite and pearlite substantially free of acicular ferrite and grain boundary ferrite films, of an as-continuously cast beam blank in accordance with the invention.

Upon final cooling and solidification of the as-continuously cast beam blank in accordance with the invention, as shown in FIG. 1, the crystal grainstructure thereof will be typically that shown in the photomicrograph constituting FIG. 2. As may be seen from the photomicrograph of FIG. 2, the micro-structure is of fine ferrite and pearlite substantially free of acicular ferrite and grain boundary ferrite films.

EXAMPLES

By way of specific examples demonstrating the invention the following experimental as-continuously cast beam blanks in accordance with the invention were made from the steel compositions set forth in Table I.

TABLE I

| HEAT # | C | Mn | P | S | Si | Cu | Ni | Cr | Mo | Sn | Fe | |
|---|---|---|---|---|---|---|---|---|---|---|---|---|
| TRIAL 1 | 8-4499 | .14 | .85 | .009 | .031 | .24 | .27 | .11 | .13 | .033 | .011 | balance |
| TRIAL 2 | 8-4731 | .16 | .79 | .010 | .033 | .25 | .25 | .09 | .08 | .022 | .010 | balance |

Trial 1 of the composition set forth in Table I consisted of the production of fifty-six beam blank samples and Trial 2 consisted of the production of seventy-two beam blank samples, all of which having the approximate shape as shown in FIG. 1. In Trial 1, the as-continuously cast flange thickness of the beam blanks was 2.5 inches and the web thickness was 2 inches. The samples were approximately 3.7 inches wide. In Trial 2, the as-continuously cast flange thickness of the beam blanks was 3½ inches (average) and the web thickness was 4 inches. The samples were heated in a natural gas fired furnace to approximately 2300° F. for hot rolling, with the hot rolling finishing temperatures of the samples ranging from 1960° F. for samples rolled to reduction ratios of 1.7 to 2.5 to less than 1400° F. for samples having higher reduction ratios of, for example, 8.5. Qualitative examination cf the hot rolled samples revealed no splitting or tearing of edges with good overall sample appearance. The sample width was approximately 4 inches after rolling with the length being proportional to thickness reduction.

Figure 5:
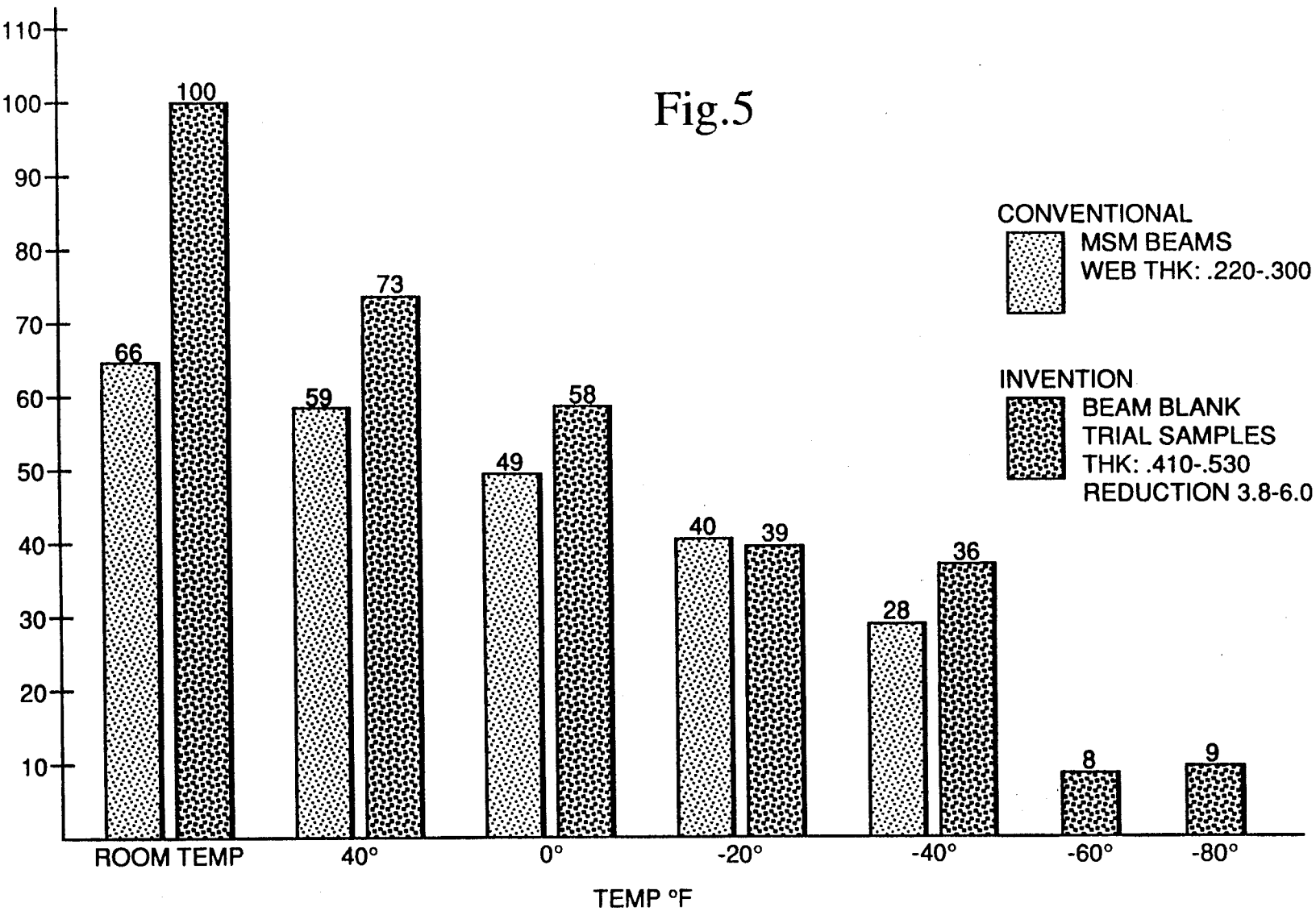
FIG. 5 is a series of bar graphs comparing the Charpy impact values of a conventional beam blank with one in accordance with the invention at various indicated temperatures.
Figure 6:
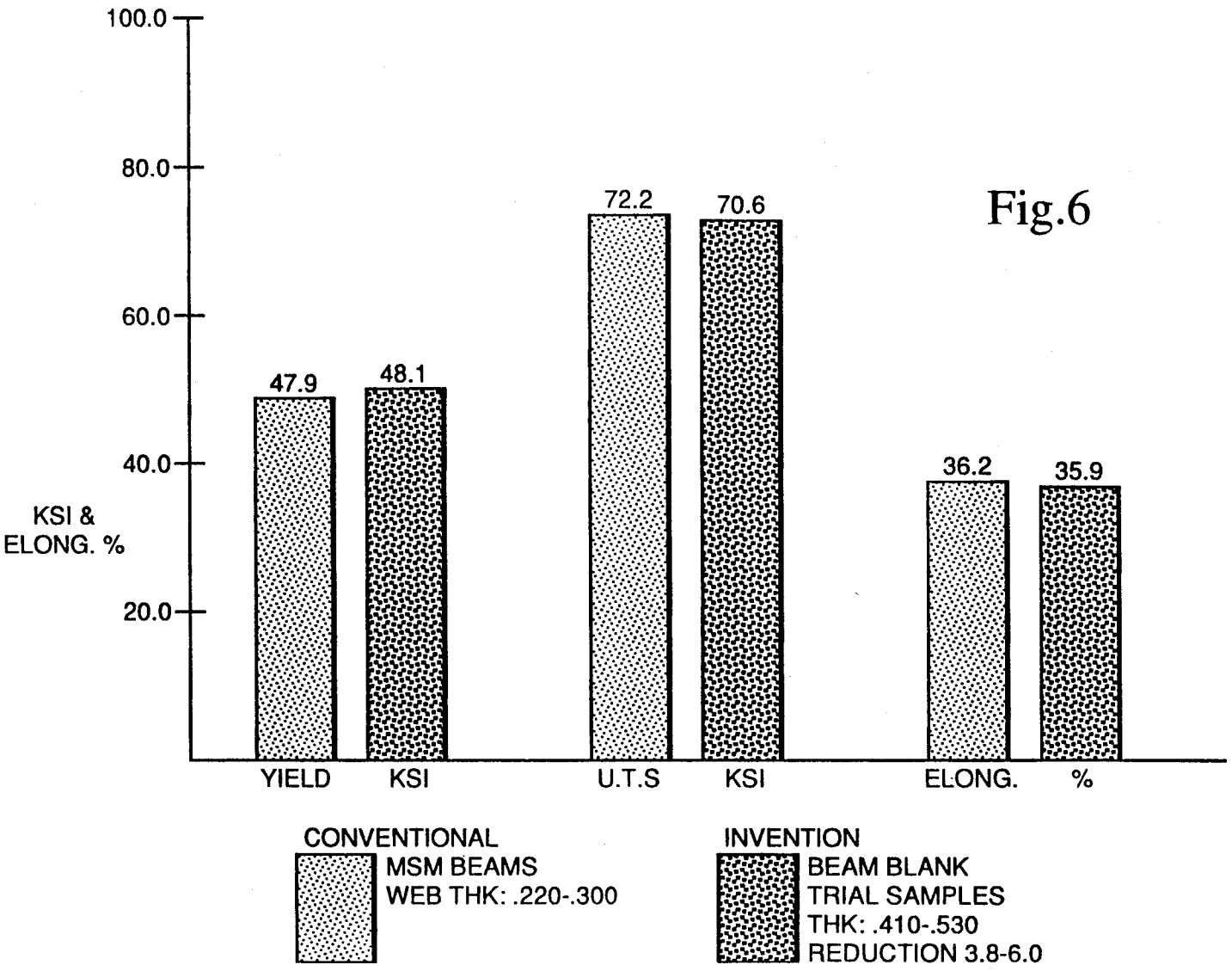
FIG. 6 is a series of bar graphs comparing the tensile properties of a conventional beam blank with one in accordance with the invention.

The Charpy impact values (FIG. 5) and the tensile test values (FIG. 6) were determined for the samples of Trial 1 in accordance with ASTM-A673 and ASTM-A370 standards, respectively, and were compared to impact and tensile test data of conventional product of the Trial 2 compositions. The comparisons are indicated by the bar graphs of FIG. 5 and FIG. 6. As may be seen from this data, the samples of the invention exhibited mechanical properties superior or equal to the conventional product. These properties were achieved with the samples of the invention with reduction ratios during hot rolling of approximately 2 to 1 while, the prior art samples required reduction ratios of approximately 6 to 1. As discussed above, by lowering the reduction ratios necessary to achieve the required mechanical properties in accordance with the invention, economics in both processing and rolling equipment requirements are achieved.

While particular embodiments of the invention, and the best mode contemplated by the inventors for carrying out the invention, have been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

We claim:

1. An as-continuously cast beam blank comprising a web portion and a plurality of opposed flange precursor portions extending from opposite ends of sad web portion, said web portion having an average thickness of no greater than about 3 inches, and each of said flange precursor portions having an average thickness of no greater than about 3 inches, said blank having the microstructure illustrated in FIG. 2 substantially throughout the cross-section of said beam blank.

2. The beam blank of claim 1 wherein the ratio of said average thickness of the flange precursor portions to said average thickness of said web portion is between about 0.5:1 to about 2:1.

3. The beam blank of claim 1 wherein said web portion and each of said plurality of flange precursor portions has an average thickness within the range of about 1½ to about 3 inches.

4. The beam blank of claim 2 wherein said web portion and each of said plurality of flange precursor portions has an average thickness within the range of about 1½ to about 3 inches.

5. The beam blank of claims 1, 2, 3 or 4 wherein said web portion has an average thickness greater than the average thickness of each of said plurality of flange precursor portions.

6. The beam blank of claims 1, 2, 3 or 4 wherein said web portion has an average thickness less than the average thickness of each of said plurality of flange precursor portions.

7. The beam blank of claims 1, 2, 3 or 4 wherein said web portion and each of said plurality of flange precursor portions has a substantially equal average thickness.

8. The beam blank of claims 1, 2, 3 or 4 wherein two flange precursor portions extend from each end of said web portion.

9. The beam blank of claims 1, 2, 3 or 4 wherein each of said flange precursor portions has substantially parallel sides.

10. The beam blank of claim 5 wherein each of said flange precursor portions has substantially parallel sides.

11. The beam blank of claim 6 wherein each of said flange precursor portions has substantially parallel sides.

12. The beam blank of claim 7 wherein each of said flange precursor portions has substantially parallel sides.

13. The beam blank of claim 8 wherein each of said flange precursor portions has substantially parallel sides.

14. The beam blank of claim 9 wherein two flange precursor portions extend from each end of said web portion, said two flange precursor portions extending from each end of said web portion being separated by an angle within the range of about 30 to about 180 degrees.

15. The beam blank of claim 10 wherein two flange precursor portions extend from each end of said web portion, said two flange precursor portion's extending from each end of said web portion being separated by an angle within the range of about 30 to about 180 degrees.

16. The beam blank of claim wherein two flange precursor portions extend from each end of said web portion, said two flange precursor portions extending from each end of said web portion being separated by an angle within the range of about 30 to about 180 degrees.

17. The beam blank of claim 12 wherein two flange precursor portions extend from each end of said web portion, said two flange precursor portions extending from each end of said web portion being separated by an angle within the range of about 30 to about 180 degrees.

18. The beam blank of claim 13 wherein said two flange precursor portions extending from each end of said web portion are separated by an angle within the range of about 30 to about 180 degrees.

19. A beam formed from the beam blank of claims 1, 2, 3 or 4.

20. A beam formed from the beam blank of claim 5.

21. A beam formed from the beam blank of claim 6.

22. A beam formed from the beam blank of claim 7.

23. A beam formed from the beam blank of claim 8.

24. A beam formed from the beam blank of claim 9.

25. A beam formed from the beam blank of claim 10.

26. A beam formed from the beam blank of claim 24.

27. A beam formed from the beam blank of claim 15.

28. A beam formed from the beam blank of claim 11.

29. A beam formed from the beam blank of claim 12.

30. A beam formed from the beam blank of claim 13.

31. A beam formed from the beam blank of claim 16.

32. A beam formed from the beam blank of claim 17.

33. A beam formed from the beam blank of claim 18.

34. An as-continuously cast beam blank comprising a web portion and plurality of opposed flange precursor portions extending from opposite ends of said web portion, said web portion having an average thickness of no greater than about 3 inches, each of said flange precursor portions having an average thickness of no greater than about 3 inches, said web portion and flange precursor portions having a substantially uniform crystal grain structure of fine ferrite and pearlite substantially free of acicular ferrite and grain boundary ferrite films substantially throughout the cross-section thereof.

35. A process for making a beam, comprising the steps of continuously casting a beam blank comprising a web portion and a plurality of opposed flange precurser portions extending from opposite ends of said web portion, said web portion having an average thickness of no greater than about 3 inches, and each of said flange precursor portions having an average thickness of no greater than about 3 inches, said blank having the microstructure illustrated in FIG. 2 substantially throughout its cross-section, and thereafter reducing said as-continuously cast beam blank through rolling by a reduction of no greater than about 3:1, whereby the final finished beam shape and dimension is attained.

36. The process of claim 35, wherein said rolling comprises hot rolling, and the number of rolling passes whereby said final finished beam shape and dimension is provided does not exceed about 15 passes.

37. The process of claim 35, wherein the ratio of said average thickness of the flange precursor portions to said average thickness of said web portion of said beam blank is between about 0.5:1 to about 2:1.

38. The process of claims 35, 36 or 37, wherein said web portion and each of said plurality of flange precursor portions of said beam blank has an average thickness within the range of about 1½ to about 3 inches.

39. The process of claims 35, 36, or 37 wherein said web portion has an average thickness greater than the average thickness of each of said plurality of flange precursor portions of said beam blank.

40. The process of claims 35, 36 or 37 wherein said web portion has an average thickness less than the average thickness of each of said plurality of flange precursor portions of said beam blank.

41. The process of claims 35, 36 or 37 wherein said web portion and each of said plurality of flange precursor portions of said beam blank has a substantially equal average thickness.

42. The process of claims 35, 36, or 37 wherein two flange precursor portions extend form each end of said web portion of said beam blank, said two flange precursor portions extending from each end of said web portion being separated by an angle within the range of about 30 to about 180 degrees.

43. The process of claim 38 wherein two flange precursor portions extend from each end of said web portion of said beam blank, said two flange precursor portions extending from each end of said web portion being separated by an angle within the range of about 30 to about 180 degrees.

44. The process of claim 39 wherein two flange precursor portions extend from each end of said web portion of said beam blank, said two flange precursor portions extending from each end of said web portion being separated by an angle within the range of about 30 to about 180 degrees.

45. The process of claim 40 wherein two flange precursor portions extend from each end of said web portion of said beam blank, said two flange precursor portions extending from each end of said web portion being separated by an angle within the range of about 30 to about 180 degrees.

46. The process of claim 41 wherein two flange precursor portions extend from each end of said web portion of said beam blank, said two flange precursor portions extending from each end of said web portion being separated by an angle within the range of about 30 to about 180 degrees.

47. A beam produced by the process of claims 65, 66 or 67.

48. A beam produced by the process of claim 38.

49. A beam produced by the process of claim 39.

50. A beam produced by the process of claim 40.

51. A beam produced by the process of claim 41.

52. A beam produced by the process of claim 42.

53. A beam produced by the process of claim 43.

54. A beam produced by the process of claim 44.

55. A beam produced by the process of claim 45.

56. A beam produced by the process of claim 46.

* * * * *

UNITED STATES PATENT AND TRADEMARK OFFICE

CERTIFICATE OF CORRECTION

PATENT NO. : 5,082,746

DATED : January 21, 1992

INVENTOR(S) : Forward et al.

It is certified that error appears in the above-identified patent and that said Letters Patent is hereby corrected as shown below:

Column 3, Line 1, "Steel in the USSR" should read --Steel in the USSR--.

Column 3,Line 21, after "ISIJ" delete "." and insert --,--.

Column 3, Line 22, "Iro" should read --Iron--.

Column 4, Line 59, "supra" should read --supra--.

Column 5, In the Table after "7.9:1"insert --

H= finished beam height (web length plus thickness of each flange):

B= finished flange width.--

Column 48 Line 47, "12" should read --12--.

Column 7, Line 58, "metalurgical" should read --metallurgical--.

Column 11, Line 41 "not" should read --not--.

Column 11, Line 58, after magnification insert --)--.

Column 11, Line 60, after magnification insert --)--.

Column 12, Line 13, after "about" and before "degrees" delete "½" and insert --180--.

Column 12, Line 31, after "B" and before "1" delete "-".

UNITED STATES PATENT AND TRADEMARK OFFICE

CERTIFICATE OF CORRECTION

PATENT NO. : 5,082,746

DATED : January 21, 1992

INVENTOR(S) : Forward et al.

It is certified that error appears in the above-identified patent and that said Letters Patent is hereby corrected as shown below:

Column 14, Line 53, "portion's" should read --portions--.

Column 14, Line 57, after "claim" and before "wherein" insert --11--.

Column 15, Line 32, "precurser" should read --precursor--.

Column 16, Line 43-44, "65, 66, or 67" should read --35, 36, or 37--.

Signed and Sealed this

Seventh Day of September, 1993

Bruce Lehman

*Attest:*

BRUCE LEHMAN

*Attesting Officer*

*Commissioner of Patents and Trademarks*